United States Patent [19]

Klaeger

[11] Patent Number: 4,922,875

[45] Date of Patent: May 8, 1990

[54] POWER DRIVEN, POSITIVE DISPLACEMENT, COMBUSTION CHAMBER FOR PRODUCTION OF MIXTURES OF STEAM AND EXHAUST GASES

[75] Inventor: Joseph H. Klaeger, Hondo, Tex.

[73] Assignee: Gail Whicomb, Houston, Tex.

[21] Appl. No.: 96,940

[22] Filed: Sep. 15, 1987

[51] Int. Cl.[5] ..... F02B 71/00

[52] U.S. Cl. ..... 123/46 SC; 123/56 R

[58] Field of Search ..... 123/46 R, 46 SC, 56 R, 123/56 AC, 56 BC, 59 R, 25 P

[56] References Cited

U.S. PATENT DOCUMENTS

| | | | |
|---|---|---|---|
| 88,767 | 4/1869 | Atwater | 123/46 SC |
| 1,224,705 | 5/1917 | Brown | 123/46 SC |
| 3,853,100 | 12/1974 | Braun | 123/46 SC |
| 3,998,049 | 12/1976 | McKinley et al. | 123/46 R |
| 4,589,380 | 5/1986 | Coad | 123/46 R |

*Primary Examiner*—David A. Okonsky

*Attorney, Agent, or Firm*—Cox & Smith, Inc.

[57] ABSTRACT

Apparatus for generating hot combustion gases and steam including a piston block with a piston reciprocally mounted in a bore therethrough having solenoids and sensors for selectively introducing hydraulic fluid into the bore on the first side of the piston to move the piston. Inlets and sensors for selectively introducing air and fuel into the combustion chamber comprising a portion of the bore and to initiate combustion are also provided. The hydraulic fluid used to move the piston is introduced into the bore in a discharge chamber in the bore on the second side of the piston, vaporized and exhausted into a well through an exhaust valve. The exhaust valve is biased toward the closed position by a pneumatic cylinder which resists the force of combustion. Charging of the combustion chamber and the direction of piston movement are controlled by proximity sensors which sense the position of reciprocating control rods and activate a hydraulic spool valve for switching the flow of hydraulic fluid to move the piston.

17 Claims, 5 Drawing Sheets

POWER DRIVEN, POSITIVE DISPLACEMENT, COMBUSTION CHAMBER FOR PRODUCTION OF MIXTURES OF STEAM AND EXHAUST GASES

BACKGROUND OF THE INVENTION

The present invention relates to a power driven, positive displacement combustion chamber for use in the production of steam, combustion gases, or mixtures of steam and combustion gases. One area of application for an apparatus of this type is in the production of crude oil. As the production of oil from a reservoir declines, a rate of production is reached at which further production of oil is no longer economical. Several methods have been utilized to stimulate the producing formations where crude oil is held to increase the rate of production to economic levels. Most of these methods require the use of large, expensive compression units to force an inert gas into the reservoir by injecting the gas under high pressure into the well. It has generally not been economical to stimulate production using such techniques on smaller wells or reservoirs or on wells with high downhole pressures because of the high capital and operating costs for the facilities required. At least part of the reason for those high operating costs is that such techniques are thermally inefficient, resulting in requirements for fuel which are disproportionate to the production. The inefficiency is also the result of the necessity for overcoming the downhole pressure to make it possible to inject the gas. The apparatus of the present invention overcomes many of these problems.

It is therefore, an object of the present invention to provide an apparatus for supplying either steam, combustion gases, or mixtures of steam and combustion gases for use in enhanced oil recovery operations, or in any other application where these components are required. It is another object of the present invention to provide these mixtures without requiring the compression of large quantities of combustion air to high pressures. It is a further object of the present invention to provide a combustion chamber which can operate efficiently on a wide range of hydrocarbon fuels.

It is another object of the present invention to provide an apparatus capable of supplying mixtures of steam and combustion gases in amounts suitable for stimulation of production from small wells and reservoirs while at the same time of being capable of being expanded for use on larger wells.

It is another object of the present invention to provide a hydraulic powered combustion chamber which utilizes the waste heat energy from hydraulic pump, as well as the internal combustion engine used to power the air compressor and the intercooler on the air compressor, to preheat the hydraulic fluid and which mixes this preheated hydraulic fluid with the products of combustion, thus vaporizing the hydraulic fluid, increasing the volume of gases produced, and increasing thermal efficiency.

It is a further object of the present invention to provide a combustion chamber which can utilize water, even though the water contains contaminants such as salts, as both hydraulic fluid and a source of steam, the operation of which is not impaired by those contaminants.

Other objects and advantages of the present invention will be apparent to those skilled in the art from the following description of a presently preferred embodiment of the invention.

SUMMARY OF THE INVENTION

The objects and advantages of the present invention are accomplished by providing an apparatus for generating hot combustion gates and steam comprising a piston block having a bore therethrough and a piston mounted reciprocally within the bore. Means is provided for introducing hydraulic fluid on a first side of the piston for moving the piston within the bore. A fuel inlet control rod is reciprocally mounted within the bore and is provided with means for introducing fuel into the bore on the second side of the piston. Means is also provided for initiating combustion within the bore. Means is provided for introducing the hydraulic fluid used for moving the piston into the discharge chamber on the second side of the piston. An exhaust valve movable between a first closed position and a second open position allows the combustion gases to escape from the bore. Control means actuated by the fuel inlet control rod initiates the introduction of fuel into the bore as well as the introduction of hydraulic fluid into the bore on the first side of the piston.

The present invention also comprises means for introducing the hydraulic fluid into a discharge chamber in the bore on the second side of the piston in the form of a passage in the piston block in close proximity to the bore which allows heat from the combustion of the fuel therein to be transmitted to the hydraulic fluid as the fluid passes into the discharge chamber. Also provided is means for mounting a second identical apparatus on each side of the piston block, with the piston of each such apparatus mounted to each end of a common piston rod. The hydraulic fluid used to move a first piston is introduced into the discharge chamber on the second side of a second piston at the same time that the hydraulic fluid is introduced on the first side of the second piston to displace combustion gases from the bore into the discharge chamber to mix with hydraulic fluid, creating a mixture of steam and gases.

DETAILED DESCRIPTION OF THE PREFERRED EMBODIMENT

Figure 1:
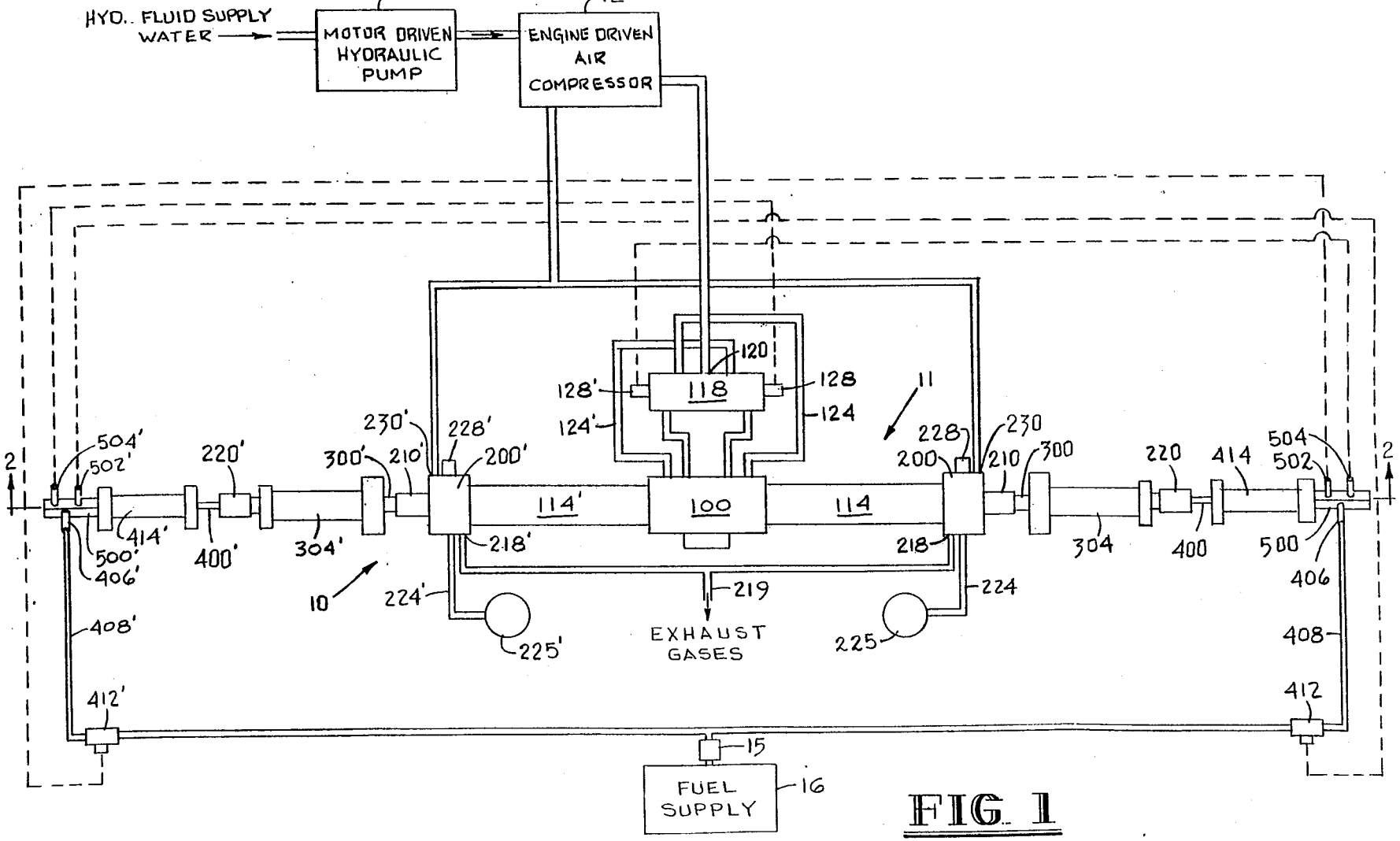
FIG. 1 is a schematic diagram of an apparatus constructed according to the teachings of the present invention.
Figure 2A:
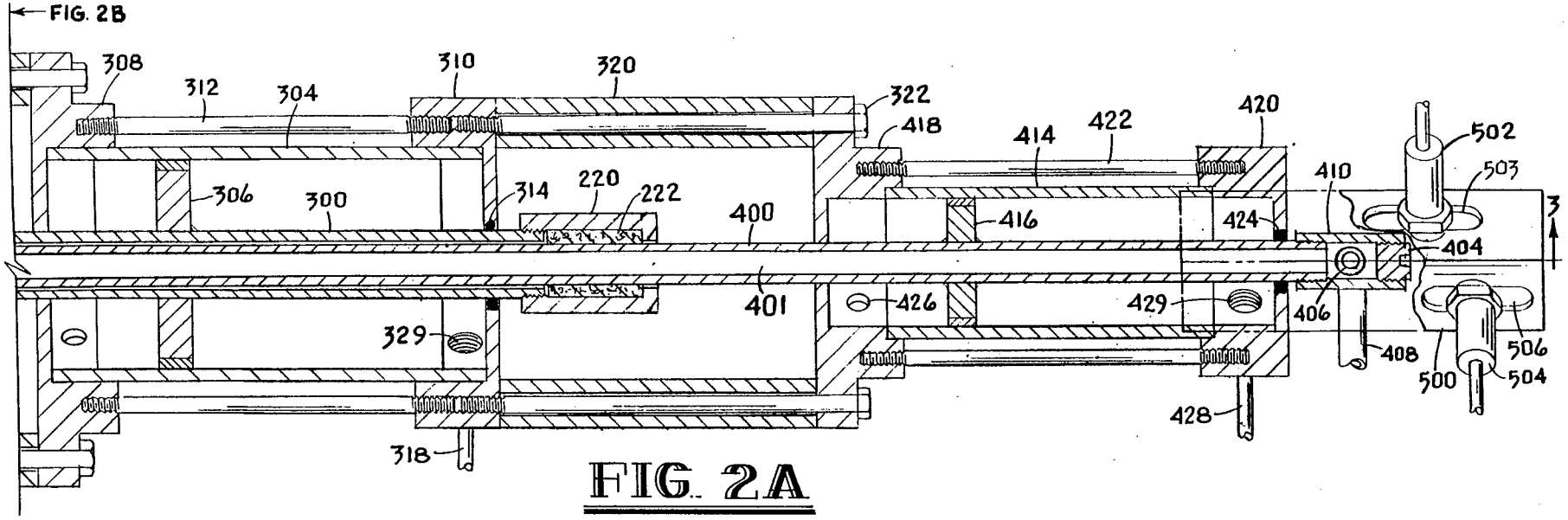
FIGS. 2A–2D are longitudinal sectional views of a presently preferred embodiment of the invention taken along the lines 2—2 in FIG. 1.
Figure 3A:
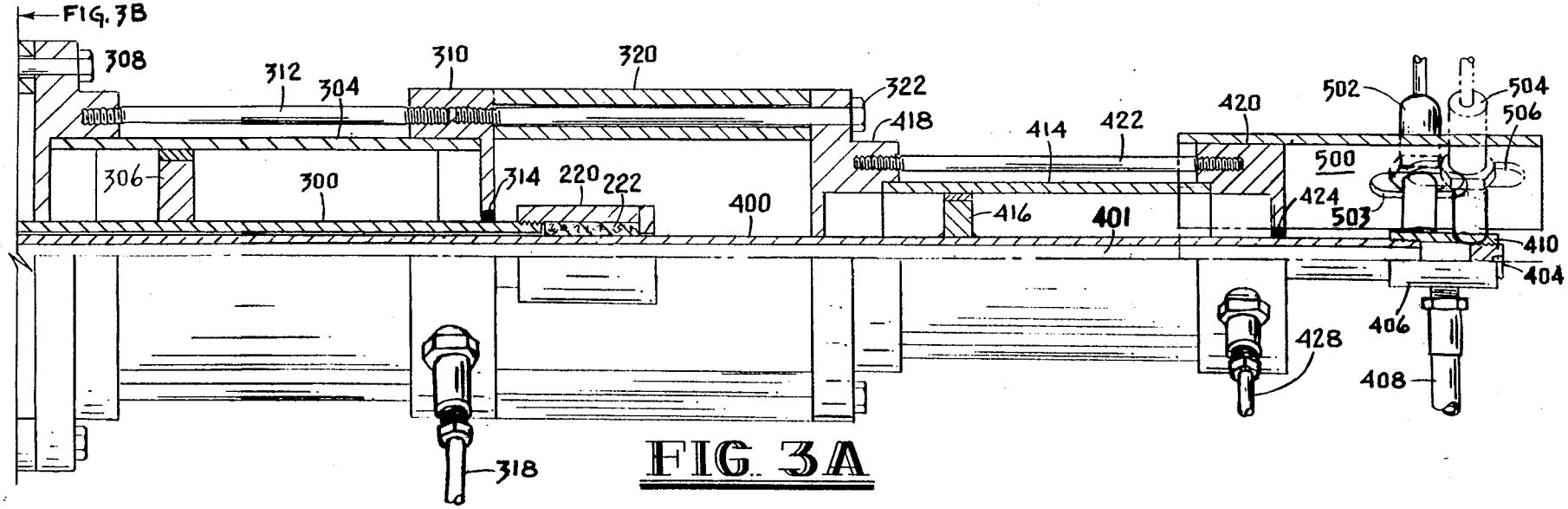
FIGS. 3A–3D are partial sectional view of the power driven combustion chamber of FIG. 2, taken along the lines 3—3 in FIG. 2.
Figure 2B:
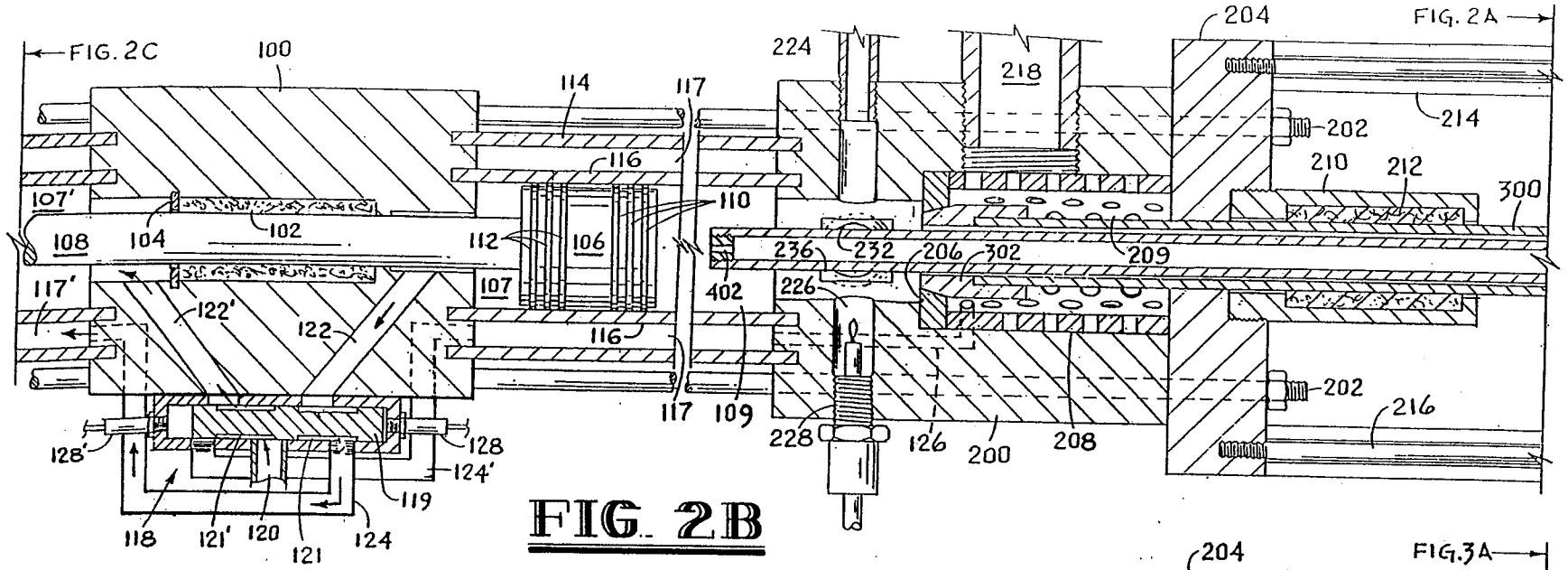
Figure 3B:
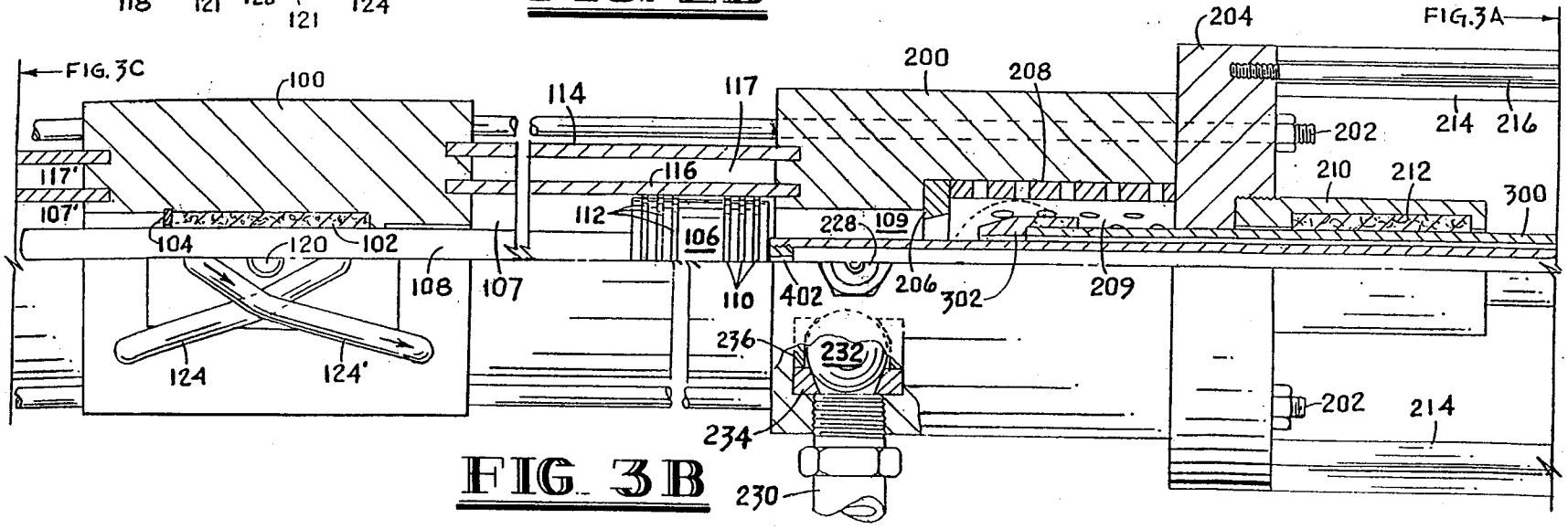
Figure 2C:
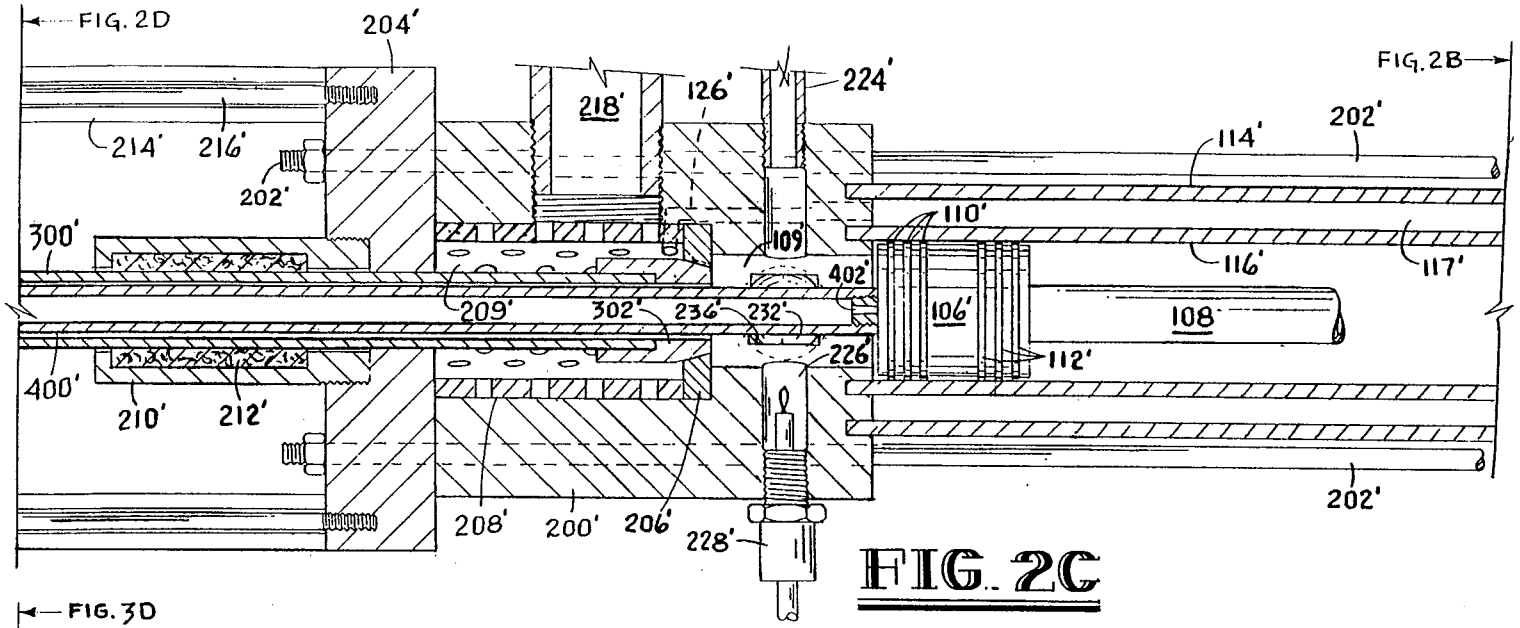
Figure 3C:
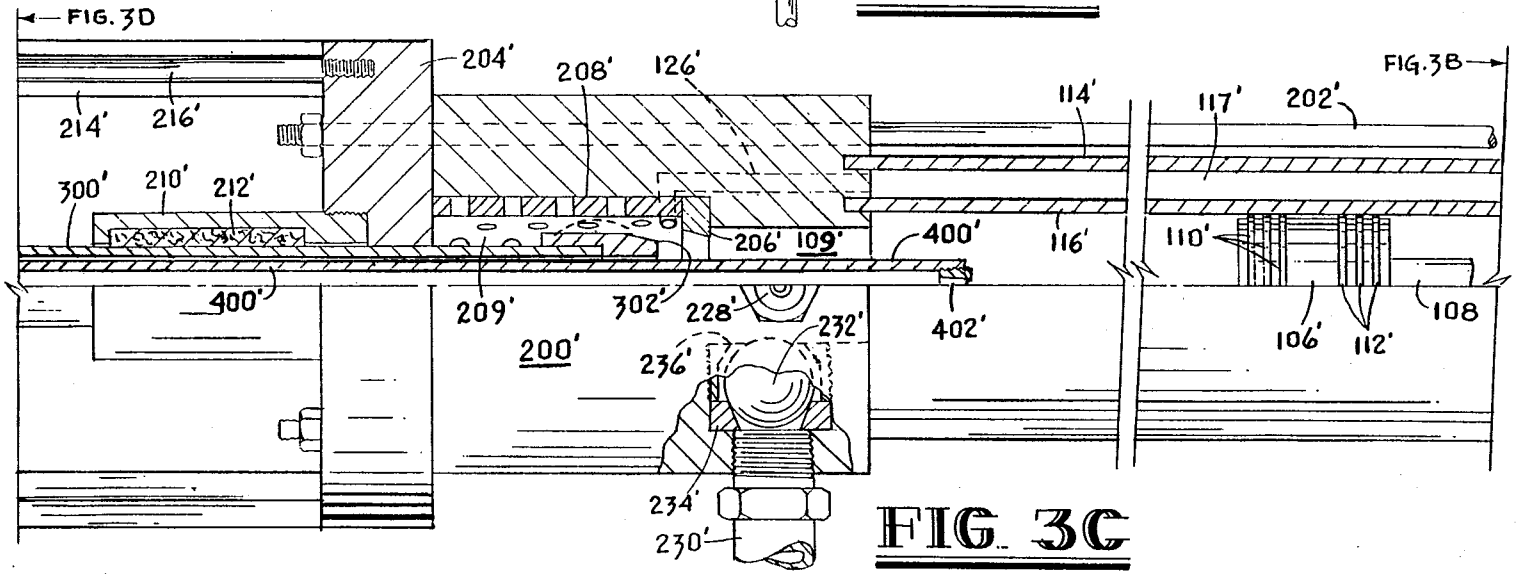
Figure 2D:
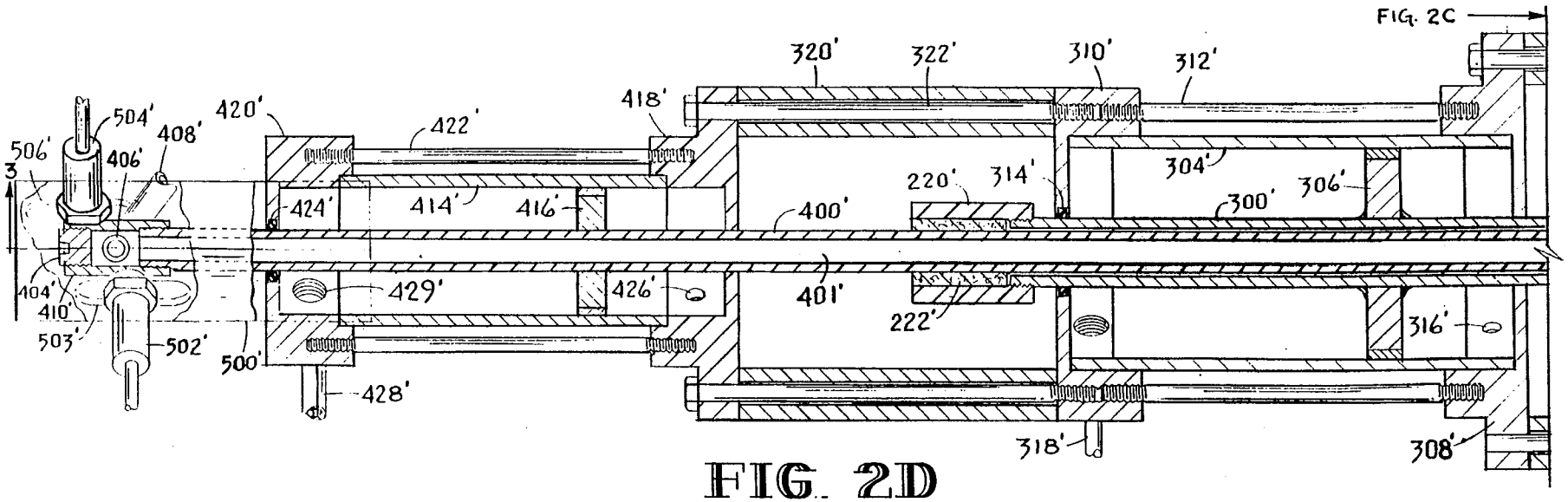
Figure 3D:
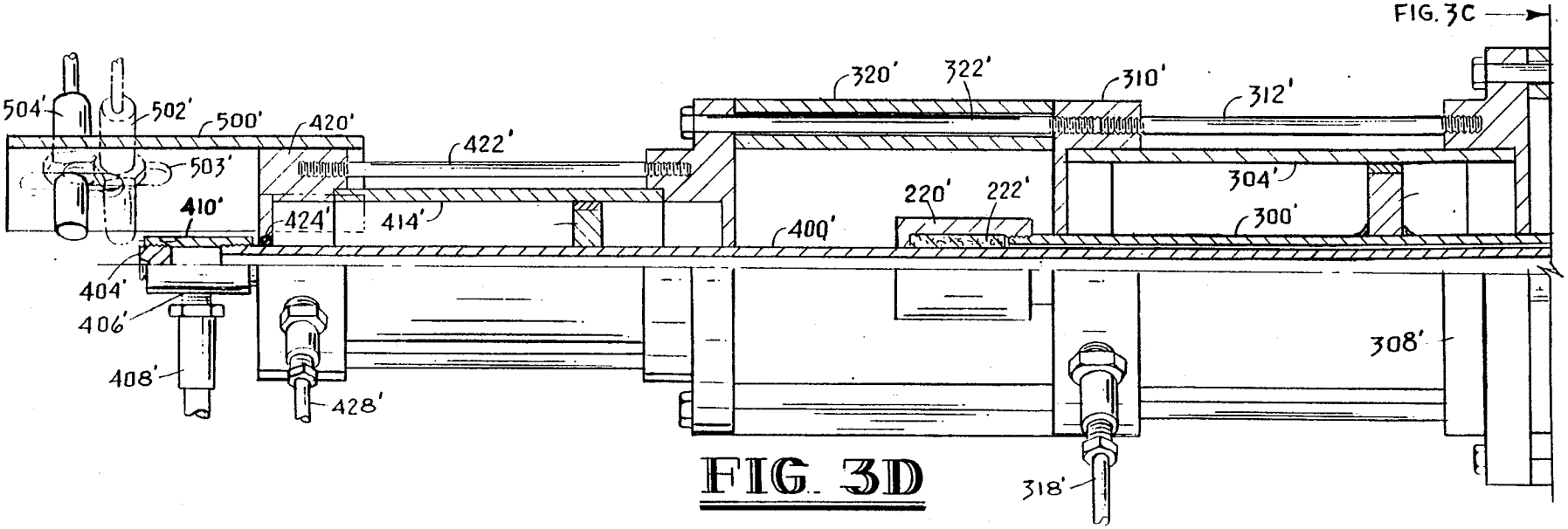

Referring to FIG. 1, there is shown a schematic diagram of a power driven combustion chamber 10 constructed in accordance with the present invention. Although the presently preferred embodiment shown in FIG. 1 includes two combustion chambers mounted to a single piston block 11, it will be understood by those skilled in the art who have the benefit of this disclosure that a single combustion chamber can be constructed in accordance with the teachings of the present invention, as could a large number of such combustion chambers, each attached, for instance to a common hydraulic drive. Because identical combustion chambers can be mounted to a single piston block 11 in accordance with the teachings of the present invention, the structural parts of each of the combustion chambers of the embodiment of the invention shown in the figures are numbered with corresponding, primed numerals and referred to in the singular.

The presently preferred embodiment shown in FIG. 1 generally comprises a piston block 11 comprising center bulkhead 100, combustion block 200 and 200', exhaust control rod 300 and 300'; and fuel inlet control rod 400 and 400'. Although in the presently preferred embodiment, two internal combustion engines (not shown) are used to power the combustion chamber 10, it will be understood by those skilled in the art who have the benefit of this disclosure that a single engine can be used depending upon the size of the formation(s) to be produced, availability of external power, the type of fuel available and the power requirements of the particular application. Consequently, an engine driven air compressor is shown schematically at reference numeral 12 in FIG. 1. A hydraulic pump is shown schematically at reference numeral 18, and hydraulic fluid, water in the presently preferred embodiment, is supplied to hydraulic pump 18 prior to being introduced into power driven combustion chamber 10. To increase the operating efficiency of combustion chamber 10, the hydraulic fluid is passed through heat exchangers with the exhaust from the intercooler and exhaust of engine driven air compressor 12. The heated hydraulic fluid is supplied to the power driven combustion chamber 10 at the inlet port 120 of hydraulic spool valve 118. Hydraulic fluid bypass port 124 and 124' of center bulkhead 100 allow hydraulic fluid to enter center bulkhead 100 as will be explained. Combustion block 200 and 200' is mounted to the hydraulic fluid jacket 114 and 114' which is mounted to center bulkhead 100. Glow plug 228 and 228', pressure sensing port 224 and 224', pressure gauge 225 and 225', and exhaust control rod packing gland 220 and 220' are mounted in combustion block 200 and 200'. Exhaust gases generated within power driven combustion chamber 10 are exhausted from exhaust port 218 and 218' and routed through line 219 to the injection well, or to other such use. Exhaust control rod 300 and 300' is reciprocally mounted within the bore of combustion block 200 and 200' and extends from within combustion block 200 and 200' through the exhaust control rod packing gland 210 and 210', through exhaust control cylinder 304 and 304', and terminates at exhaust control rod packing gland 220 and 220'.

Fuel inlet control rod 400 and 400' is reciprocally mounted within the bore of exhaust control rod 300 and 300' (see FIGS. 2 and 3) and extends through exhaust control rod packing gland 220 and 220' and also into and through fuel control cylinder 414 and 414'. Fuel for combustion enters fuel inlet control rod 400 and 400' through fuel inlet port 406 and 406' from fuel supply 16 via fuel inlet hose 408 and 408'. Combustion chamber 10 is provided with means for controlling the introduction of fuel into a bore 107 and 107' (see FIGS. 2 and 3) in center bulkhead 100 and for reversing the direction of travel of a piston 106 and 106' reciprocally mounted in bore 107 and 107' which is actuated by fuel inlet control rod 400 and 400' in the form of proximity sensors 502 and 502' and 504 and 504' as will be explained. The flow of fuel into fuel inlet control rod 400 and 400' is controlled by fuel solenoid valve 412 and 412' in fuel inlet hose 408 and 408' which receives fuel from an electrically driven fuel pump which is shown schematically at reference numeral 15.

Referring to FIG. 2, the power driven combustion chamber 10 is shown in further detail. Center bulkhead 100 is provided with a bore 107 and 107' extending longitudinally therethrough. Piston 106 and 106' is reciprocally mounted within bore 107 and 107'. In the preferred embodiment shown in FIG. 2, both piston 106 and piston 106' are mounted on the ends of a single, common piston rod 108. Piston 106 and 106' is furnished with sets of hydraulic seal rings 112 and 112' on the first end thereof and combustion seal rings 110 and 110' on the second end. Hydraulic fluid is prevented from leaking around piston rod 108 into bore 107 by a shaft packing 102 which is retained within center bulkhead 100 by packing retaining ring 104. Center bulkhead 100 is provided with means for selectively introducing hydraulic fluid into the bore 107 and 107' on the first side of piston 106 and 106' in the form of hydraulic spool valve 118, which is provided with a spool 119 reciprocally mounted therein and having a circumferential groove 121 (and 121') therein such that internal hydraulic fluid passage 122 (and 122') communicates with hydraulic fluid bypass port 124 and (124') depending upon the position of spool 119.

Combustion chamber liner 116 and 116' is mounted to center bulkhead 100 and encloses a portion of bore 107 and 107'. Fluid jacket casing 114 and 114' and combustion cylinder liner 116 and 116' are seated in concentric grooves (not numbered) in center bulkhead 100 and combustion block 200 and 200' and define an annulus 117 and 117' in fluid communication with the portion of hydraulic fluid bypass port 124 and 124' within center bulkhead 100. Annulus 117 and 117' is also in fluid communication with the passage 126 and 126' in combustion block 200 and 200'. Fluid jacket casing 114 and 114' and combustion chamber liner 116 and 116' are compressibly contained and mounted to center bulkhead 100 and combustion block 200 and 200' by tension rods 202 which extend through combustion block 200 and 200' and center bulkhead 100.

Piston 106 is initially positioned closest to center bulkhead 100, and as hydraulic fluid enters bore 107 from hydraulic pump 18, piston 106 is forced in a direction away from center bulkhead 100 and piston 106', connected to piston 106 through piston rod 108, moves toward center bulkhead 100. As piston 106' moves in the direction toward center bulkhead 100, hydraulic fluid is forced out of bore 107', into internal hydraulic fluid passage 122', through the circumferential groove 121' in spool 119 and into hydraulic fluid bypass port 124' in the direction of the arrows shown in FIG. 2B into annulus 117, passes through passage 126 in combustion block 200, and into the discharge chamber 209 which comprises the end of bore 107 on the second side of piston 106 to mix with the combustion gases therein. As will be described, at or near the maximum extension of piston 106, spool 119 is shifted to close the connection between port 120 and internal hydraulic fluid passage 122 and open the connection between internal hydraulic fluid passage 122 and hydraulic fluid bypass port 124. At the same time, the connection between port 120 and internal hydraulic passage 122' is opened so that hydraulic fluid is pumped into the bore 107' on the first side of piston 106' through circumferential groove 121' to cause piston 106 and 106' to reverse direction and the same sequence of events repeats on that side of power driven combustion chamber 10.

The portion of bore 107 and 107' on the second side of piston 106 and 106' comprises a combustion chamber 109 and 109′ that is provided with means for introducing air in the form of air inlet port 230 and 230′. Air inlet port 230 and 230′ opens into bore 107 and 107′ through air inlet valve 231 and 231′ comprising ball 232 and 232′ confined within basket 236 and 236′ and valve seat 234 and 234′. Combustion air is introduced into combustion chamber 109 and 109′ when the pressure therein falls below the pressure of the air supplied by air compressor 12, allowing air to enter through air inlet ports 230 and 230′ when ball 232 and 232′ lift off of valve seat 234 and 234′. In practice, it has been found that air pressures of between 250 and 300 psi generally result in optimum combustion when diesel fuel is used as the fuel introduced into combustion chamber 109 and 109′. However, as is the case when other fuels are utilized, other pressures may be preferable, and even required, depending on the operating conditions. In any event, the air pressures at which optimum combustion occurs are significantly lower than the downhole pressure in many wells. For instance, the apparatus of the present invention can be used to stimulate production from formations in which pressures range as high as 1000 psi.

Fuel inlet control rod 400 and 400′ is reciprocally mounted in combustion block 200 and 200′ and extends from bore 107 and 107′ through combustion chamber 109 and 109′ on the second side of piston 106 and 106′. Means is provided for biasing fuel inlet control rod 400 and 400′ towards piston 106 and 106′ in the form of fuel control cylinder 414 and 414′. The maximum penetration of fuel inlet control rod 400 and 400′ into combustion chamber 109 and 109′ is fixed by the location of fuel control cylinder piston 416 and 416′ within fuel control cylinder 414 and 414′. Fuel control cylinder 414 and 414′ is air tight and is provided with pressurized air through line 428 and 428′ and port 429 and 429′. As piston 106 and 106′ moves in a direction away from center bulkhead 100 into contact with the nozzle 402 and 402′ end of fuel inlet control rod 400 and 400′, the air pressure on the side of fuel control cylinder piston 416 and 416′ opposite center bulkhead 100 resists that movement as a result of the movement of piston 416 and 416′, which is integral with fuel inlet control rod 400 and 400′, within fuel control cylinder 414 and 414′. The air pressure in fuel control cylinder 414 and 414′ is adjusted by increasing or decreasing the air pressure to bias fuel inlet control rod 400 and 400′ inwardly toward said center bulkhead 100 to the extent desired. Air pressures of approximately 45 pounds per square inch in fuel control cylinder 414 and 414′ have been found satisfactory in normal usage of combustion chamber 10. The maximum penetration of fuel inlet control rod 400 and 400′ into bore 107 and 107′ is limited by the mounting flange 418 and 418′ of fuel control cylinder 414 and 414′. The travel of fuel control cylinder piston 416 and 416′ towards mounting flange 418 and 418′ is unrestricted because the space between the fuel control cylinder piston 416 and 416′ and the mounting flange 418 and 418′ is vented to the atmosphere through vent 426 and 426′.

Fuel inlet control rod 400 and 400′ is provided with means for introducing fuel into the combustion chamber 109 and 109′ in bore 107 and 107′ on the second side of piston 106 and 106′ in the form of a longitudinal passage 401 and 401′ therethrough and nozzle 402 and 402′ mounted in the end thereof. Passage 401 and 401′ connects fuel inlet nozzle 406 and 406′, which receives fuel from fuel inlet hose 408 and 408′, to the second side of bore 107 and 107′. Nozzle 402 and 402′ is threaded into the end of fuel inlet control rod 400 and 400′ and provided with key slots (not shown) to allow changing to a nozzle 402 and 402′ having a passage (not numbered) therethrough of different diameter to increase or decrease the amount of fuel introduced into the bore 107 and 107′ on the second side of piston 106 and 106′.

The amount of fuel introduced into combustion chamber 109 and 109′ is further controlled by the movement of fuel inlet control rod 400 and 400′ in combustion block 200 and 200′. As noted above, piston 106 and 106′ contacts the nozzle 402 and 402′ end of fuel inlet control rod 400 and 400′ while reciprocating in the direction away from center bulkhead 100, causing fuel inlet control rod 400 and 400′ to likewise reciprocate in that direction. When the outboard end of fuel inlet control rod 400 and 400′, comprising nipple 410 and 410′, plug 404 and 404′, and fuel inlet nozzle 406 and 406′, passes fuel proximity sensor 502 and 502′, fuel proximity sensor 502 and 502′ signals fuel solenoid valve 412 and 412′ (see FIG. 1) to start the flow of fuel into fuel inlet control rod 400 and 400′ through fuel inlet hose 408 and 408′. Fuel proximity sensor 502 and 502′ is adjustably mounted to mounting bracket 500 and 500′ within the slot 503 and 503′ to allow for fine adjustment of the point in the movement of said fuel inlet control rod 400 and 400′ which activates said fuel proximity sensor 502 and 502′ to control the introduction of fuel into the bore 107 and 107′ on the second side of piston 106 and 106′.

As is known to those skilled in the art, the fuel mixture in combustion chamber 109 and 109′ can be adjusted depending upon the type of fuel utilized, operating requirements, and operating economy. Adjustment is accomplished by using a flue gas detector (not shown) in line 219; if the detector indicates that the fuel mixture is too lean, proximity sensor 502 and 502′ is moved closer to center bulkhead 100 in slot 503 and 503′ in mounting bracket 500 and 500′ so that solenoid 412 and 412′ opens sooner and more fuel is introduced into combustion chamber 109 and 109′. If proximity sensor 502 and 502′ is moved as far as possible in slot 503 and 503′ and the fuel mixture is still too lean, the position of proximity sensor 504 and 504′ is adjusted outwardly in slot 506 and 506′ in mounting bracket 500 and 500′ so that activation of solenoid 128 and 128′ is delayed. Adjustment of proximity sensor 504 and 504′ in that manner continues the movement of piston 106 and 106′ away from center bulkhead 100 and increases the time that sensor 502 and 502′ remains activated, thereby increasing the amount of fuel introduced into combustion chamber 109 and 109′. As piston 106 or 106′ nears the maximum extent of travel away from center bulkhead 100, fuel inlet control rod 400 and 400′ is engaged and likewise moved outwardly. When fuel inlet control rod 400 and 400′ has been moved in that direction far enough to activate, or energize, sensor 502 and 502′, fuel solenoid 412 and 412′ is energized and injects fuel into fuel inlet control rod 400 and 400′. When fuel inlet control rod 400 and 400′ reverses direction under the influence of the spring action of the air compressed in fuel control cylinder 414 and 414′, sensor 502 and 502′ is de-energized and fuel injection ceases.

When fuel inlet control rod 400 and 400′ is forced outwardly by piston 106 and 106′ into a position in which hydraulic fluid proximity sensor 504 and 504′ is energized, hydraulic fluid proximity sensor 504 and 504′ signals the solenoid 128 mounted to hydraulic spool valve 118 of center bulkhead 100, causing spool 119 to change position to reverse the flow of hydraulic fluid into bore 107 or 107' on either side of central bulkhead 100 and the direction of travel of piston 106 and 106' as described above. As piston 106 and 106' reverses direction, fuel inlet control rod 400 and 400' also reverses direction as the air pressure fuel control cylinder 414 and 414' causes fuel control cylinder piston 416 and 416' to reverse direction. As fuel inlet control rod 400 and 400' passes proximity sensor 502 and 502', solenoid 412 and 412' is deactivated, causing the addition of fuel to combustion chamber 109 and 109' to cease as described above. Hydraulic fluid which had previously filled the bore 107 and 107' on the first side of piston 106 and 106' when piston 106 and 106' was at maximum outward displacement (with reference to center bulkhead 100) is then forced, by the reversal of the direction of travel of piston 106 and 106', from the bore 107 and 107' through internal hydraulic fluid passages 122 and 122', through the circumferential groove 121 and 121' of hydraulic spool valve 118, thence through hydraulic fluid bypass port 124 and 124' into the annulus 117 and 117'During the passage through annulus 117 and 117', the hydraulic fluid absorbs energy by heat transfer through combustion cylinder liner 116 and 116', resulting in an increase in the temperature of the hydraulic fluid. At the same time, the mixture of fuel and air on the second side of piston 106 and 106' ignites, either through spontaneous ignition initiated by conditions of pressure, volume and temperature, or by the action of a means for initiating combustion of the fuel such as glow plug 228 and 228'. When the pressure in bore 107 and 107' on the second side of piston 106 and 106' reaches a point sufficiently high, exhaust valve plug 302 and 302' is pushed out of a first position closing bore 107 and 107', in which valve plug 302 and 302' engages exhaust plug seat 206 and 206', into a second position opening bore 107 and 107', allowing combustion gases to exhaust through the annulus between exhaust valve seat 206 and 206' and exhaust valve plug 302 and 302' into the discharge chamber 209 and 209' in the end of bore 107 and 107' formed by exhaust valve retainer 208 and 208' and end flange 204 and 204'.

Exhaust valve plug 302 and 302', like exhaust control cylinder piston 306 and 306', is integral with exhaust control rod 300 and 300'. Exhaust control cylinder piston 306 and 306' is contained within exhaust control cylinder 304 and 304' and biases exhaust valve plug 302 and 302' toward center bulkhead 100 into contact with exhaust valve seat 206 and 206' in the same manner as fuel inlet control rod 300 and 300' is biased in that direction. The force with which exhaust plug 302 and 302' is biased in that direction is adjusted by increasing or decreasing the amount of air introduced into exhaust control cylinder 304 and 304' from line 318 and 318', the portion of exhaust control cylinder 304 and 304' on the other side of piston 306 and 306' being open to the atmosphere through vent 316 and 316'. Biasing exhaust plug 302 and 302' in that manner causes exhaust plug 302 and 302' to seat in exhaust valve seat 206 and 206', thereby closing the portion of bore 107 and 107' on the second side of piston 106 and 106'. Mounting flange 308 and 308' and cap 310 and 310' limit the travel of piston 306 and 306' at either end of exhaust control cylinder 304 and 304'.

The hydraulic fluid, heated during passage through annulus 117 and 117', enters discharge chamber 209 and 209' through port 126 and 126' and is vaporized by the hot combustion gases. The quality of the steam produced is regulated by the volume of water injected into the discharge chamber. Perforations (not numbered) in exhaust valve retainer 208 and 208' allow the mixture of gases to exit through exhaust port 218 and 218' to the well or any other use for such gases. When the pressure in the bore on the second side of piston 106 and 106' is sufficiently low, the air pressure exerted on exhaust control cylinder piston 306 and 306' biases exhaust valve plug 302 and 302' into contact with exhaust valve seat 206 and 206', terminating combustion gas exhaust. In actual practice, air pressures of approximately 65–70 psi in exhaust control cylinder piston 306 and 306' have been found to be appropriate in most normal applications.

Mounting a pair of combustion chambers 10 to the same center bulkhead 100 confers a number of economies and efficiencies upon the apparatus of the present invention. For instance, when piston 106 travels in a direction away from center bulkhead 100 under the influence of hydraulic fluid entering the bore 107 on the first side of piston 106, the hydraulic fluid provides the driving force for moving the combustion gases out of combustion chamber 109, closing air inlet valve 232, moving fuel inlet control rod 400 to open the supply of fuel, and moving the hydraulic fluid in the bore 107' on the first side of piston 106' through internal hydraulic fluid passage 122', hydraulic fluid bypass port 124', annulus 117 and into discharge chamber 209. At the same time, air inlet valve 232' is opened by the decreasing pressure in combustion chamber 109', allowing air to enter combustion chamber 109' which, at the approximately 300 psi pressure described above, helps move piston 106' toward center bulkhead 100, and hence, helps move piston 106 away from center bulkhead 100. Further efficiency is created by the use of hydraulic pressure to move the mixture of combustion gases and water vapor (assuming that water is the hydraulic fluid of choice) out of discharge chamber 209 and 209' into the well.

O-ring 314 and 314', located in the hole (not numbered) in cap 310 and 310' through which exhaust control rod 300 and 300' projects, seals exhaust control cylinder 304 and 304' from exhaust control rod 300 and 300', preventing leakage of air to the atmosphere. The end of exhaust control rod 300 and 300' through which fuel inlet control rod 400 and 400' projects is provided with a packing gland 220 and 220', containing packing 222 and 222' therein, to prevent combustion gases from discharging to the atmosphere through the annulus between fuel inlet control rod 400 and 400' and exhaust control rod 300 and 300'. Likewise, packing gland 210, having packing 212 therein, is mounted in end flange 204 and 204' and seals against the outside of exhaust control rod 300 and 300'.

Although the present invention has been defined in terms of the preferred embodiment, it will be understood by those skilled in the art who have the benefit of this disclosure that modifications to the preferred embodiment can be made without departing from the spirit and scope of the present invention as set out in the following claims.

What is claimed is:

1. An apparatus for generating hot combustion gases and steam comprising:

a piston block having a bore therethrough;

a piston reciprocally mounted within the bore in said piston block, said piston having a first side and a second side;

controlling means for controlling the flow of hydraulic fluid to cause reciprocation of said piston within said bore;

a fuel inlet control rod reciprocally mounted in said piston block, said fuel inlet control rod being provided with means for introducing fuel into the bore on the second side of said piston;

means for initiating combustion of the fuel;

means for introducing hydraulic fluid used for moving said piston into a chamber means;

an exhaust valve movable between a first position closing the bore and a second position in which combustion gases in the bore on the second side of said piston escape from the bore into the chamber means; and control means actuated by said fuel inlet control rod for controlling the introduction of fuel into the bore and for controlling the controlling means.

2. The apparatus of claim 1 further comprising means for biasing said fuel inlet control rod toward said piston.

3. The apparatus of claim 1 wherein said control means includes means for sensing the position of said piston in the bore.

4. The apparatus of claim 3 wherein said position sensing means comprises a proximity sensor activated by said fuel inlet control rod.

5. The apparatus of claim 3 wherein said position sensing means comprises a first proximity sensor activated by said fuel inlet control rod to signal a solenoid valve to control the introduction of fuel into the bore.

6. The apparatus of claim 3 wherein said position sensing means comprises a second proximity sensor activated by said fuel inlet control rod to signal said controlling means to introduce hydraulic fluid into the bore on the first side of said piston.

7. The apparatus of claim 1 further comprising means for biasing said exhaust valve toward said first, closed position.

8. The apparatus of claim 7 wherein said biasing means comprises a pneumatic cylinder.

9. The apparatus of claim 8 wherein said pneumatic cylinder is provided with an exhaust valve control rod reciprocally mounted therein and integral with said exhaust valve at one end thereof and an integral piston movable within said pneumatic cylinder at the other end thereof.

10. The apparatus of claim 9 wherein the force within said exhaust valve is biased toward said first, closed position is adjusted by varying the pressure in said pneumatic cylinder.

11. The apparatus of claim 1 wherein said controlling means comprises a solenoid activated by said control means to open and close a valve, thereby selectively introducing hydraulic fluid into said bore on the first side of said piston.

12. The apparatus of claim 1 wherein said fluid introducing means comprises a passage in said piston block in close proximity to the bore therein whereby the heat from combustion of fuel in the bore is transmitted to the hydraulic fluid.

13. The apparatus of claim 1 wherein said bore is comprised of a combustion chamber and a discharge chamber.

14. The apparatus of claim 13 wherein said exhaust valve closes said combustion chamber off from said discharge chamber.

15. The apparatus of claim 1 wherein said combustion initiating means further comprises means for introducing air into the bore on the second side of said piston.

16. The apparatus of claim 15 wherein said air introducing means includes a ball valve for closing said air introducing means during the combustion of fuel introduced into the bore.

17. The apparatus of claim 1 having another such apparatus mounted to said piston block, the piston of each apparatus being mounted to a common piston rod whereby hydraulic fluid from the first side of one of said pistons is being introduced into the bore on the second side of that piston at the same time that hydraulic fluid is being introduced into the bore on the first side of the other piston to move that piston.

* * * * *